US010973717B2

(12) United States Patent
Makroum et al.

(10) Patent No.: US 10,973,717 B2
(45) Date of Patent: Apr. 13, 2021

(54) BED HAVING A CONTROL SYSTEM COMPRISING A CONTROL UNIT AND A CONTROL UNIT HAVING INTERFACES FOR A WIRELESS TRANSMISSION OF CONTROL SIGNALS

(71) Applicant: Wissner-Bosserhoff GmbH, Wickede (DE)

(72) Inventors: Kheir Eddine Makroum, Dortmund (DE); Burkhard Bönemann, Menden (DE); Carlos Bernal, Soest (DE)

(73) Assignee: Wissner-Bosserhoff GmbH, Wickede (DE)

( * ) Notice: Subject to any disclaimer, the term of this patent is extended or adjusted under 35 U.S.C. 154(b) by 539 days.

(21) Appl. No.: 15/983,396

(22) Filed: May 18, 2018

(65) Prior Publication Data

US 2019/0038489 A1 Feb. 7, 2019

(30) Foreign Application Priority Data

Aug. 3, 2017 (EP) ..... 17184705

(51) Int. Cl.
*A61G 7/018* (2006.01)
*A61G 7/015* (2006.01)

(52) U.S. Cl.
CPC ..... *A61G 7/018* (2013.01); *A61G 7/015* (2013.01)

(58) Field of Classification Search
CPC ..... A61G 7/018; A61G 7/015
See application file for complete search history.

(56) References Cited

U.S. PATENT DOCUMENTS 3,697,846 A 10/1972 Mueller
2007/0157385 A1 7/2007 Lemire et al.
2007/0210917 A1* 9/2007 Collins, Jr. ..... A61B 5/1117 340/539.1

(Continued)

FOREIGN PATENT DOCUMENTS

EP 3002695 A1 4/2016

OTHER PUBLICATIONS

European Search Report in corresponding European Patent Application No. 17184705.6, dated Feb. 20, 2018, with English translation.

*Primary Examiner* — Eric J Kurilla
(74) *Attorney, Agent, or Firm* — Edell, Shapiro & Finnan, LLC

(57) ABSTRACT

A bed with controllable components, including switches or motors of a motor-adjustable lying surface of the bed or an external interface for controlling components outside the bed via control signals, comprises: a first operating unit to operate at least one of the components, wherein the first operating unit comprises a first interface to transmit first control signals via a wire; a second operating unit to operate at least one of the components, wherein the second operating unit comprises a second interface for the wireless transmission of communication signals; and a control system to receive the first control signals from the first operating unit and to receive the communication signals from the second operating unit, wherein the control system is configured to prioritize operation of a component within or outside the bed with the first operating unit over operation of the component with the second operating unit.

17 Claims, 3 Drawing Sheets

(56) References Cited

U.S. PATENT DOCUMENTS

| | | | | |
|---|---|---|---|---|
| 2011/0208541 | A1 | 8/2011 | Wilson et al. | |
| 2019/0188992 | A1* | 6/2019 | Bodurka | G08B 25/004 |
| 2020/0060910 | A1* | 2/2020 | Lightcap | A61G 7/0516 |
| 2020/0306115 | A1* | 10/2020 | Shami | A61G 7/012 |

* cited by examiner

BED HAVING A CONTROL SYSTEM COMPRISING A CONTROL UNIT AND A CONTROL UNIT HAVING INTERFACES FOR A WIRELESS TRANSMISSION OF CONTROL SIGNALS

CROSS REFERENCE TO RELATED APPLICATIONS

This application claims foreign priority under 35 U.S.C. § 119(a)-(d) to Application No. EP 17184705.6 filed on Aug. 3, 2017, the entire contents of which are hereby incorporated by reference.

TECHNICAL FIELD

The present invention relates to a bed, in particular a medical bed, for example a hospital bed or a nursing care bed.

BACKGROUND

For medical beds, in particular, it is known that a variety of settings of a lying surface of the bed are accomplished with the aid of motors. In many beds, the height of the lying surface can be adjusted by motors. Individual elements of the lying surface can similarly be adjusted, for example a backrest, a thigh support or a lower leg support. It is also known that the inclination of the lying surface can be changed with the aid of motors. It is furthermore known that lights are connected to the bed. These can be reading lamps or under-bed lighting, among other things. It would moreover also be possible to control other components of the bed, or even external components. The external components can be a lamp, blinds or a roller blind, a door opener, for example, or something else.

To control the motors and the other components, the beds have control systems that comprise one or more operating units and a control unit. Via the operating units, a user, be it a bed occupant, be it a nurse, can generate control signals, which are relayed to the control unit via a wire or a wireless or infrared channel. The operating units comprise the necessary interfaces to accomplish this. The control unit too comprises one or, if appropriate, a plurality of interfaces to read the control signals into the control unit and to control actuators, for example switches or the like, in accordance with the control signals. These actuators then close electric circuits, for example, whereby the controlled motor or motors or other components are put into operation to adjust the bed according to the control signals.

In most of the known beds, the operating units are connected to the control units via wires. There are also some beds, however, that have remote controls as operating units, which are connected to the control units via a wireless channel.

Some beds have both a wired first operating unit and a wireless remote control as the second operating unit to perform adjustments on the bed.

If a plurality of operating units is provided in a bed, it is in principle possible that control signals for controlling different components, for example motors, or for controlling identical components with contradictory commands, for example motors in different directions, are generated by two users and relayed to the control unit. Depending on the origin of the control signals, these are referred to in the following as first or second control signals, even if they are formed according to the same specifications of a standard.

If the control signals received by a control unit contradict one another, this contradiction has to be eliminated so that there is no damage to the control system, the components, in particular the motors, and to the bed as a whole.

SUMMARY

The present invention builds on the aforementioned.

It can likewise be desirable for a special significance to generally be assigned to one operating unit or the user of this operating unit, which is intended to be reflected in that, regardless of the use of this operating unit, a control of a component of the bed by another operating unit is prevented.

The underlying object of the present invention is to avoid malfunctions resulting from contradictory control instructions.

This object is achieved according to the invention by a bed having a control system configured such that the first control signal always has priority prior over a second control signal. Any operation of the first operating unit preferably generates a first control signal, which results in the communication signals from the second operating unit coming to nothing and not causing an actuation of a component. It is thus possible for the first operating unit to be operable for actuating components of the bed or external components only after a prior activation and/or release. Just the activation and/or release of the first operating unit can lead to a first control signal being generated by the first operating unit and transmitted to the control system via the first interface. This first control signal can result in communication signals from the second operating unit not resulting in control of one of the components by the control system.

The background for the solution according to the invention is that, in principle, more confidence can or should be placed in a first control signal from a wired first operating unit. This can, on the one hand, be due to a secure connection via a wire as opposed to a wireless connection. In beds that have a wireless remote control as an operating unit and a wired operating unit, however, it can also be because the wired operating unit is generally available to the nursing staff for adjusting the bed, while the wireless remote control is generally (also) available to the bed occupant.

A first operating unit can also be an emergency stop switch, a control panel integrated into a head part, foot part or side part, a foot switch, a switch that can be mounted on a side part, a head part and/or a foot part, or any other type of switch.

The control system of a bed according to the invention may comprise a first interface for receiving the first control signals. The interface can be a standardized interface that is connected to the first operating unit via a standardized wire.

It is possible for the first interface to comprise at least one first connection for each of the first control signals. In that case, it can be a parallel interface. It is also possible, however, for the interface to comprise fewer connections than there are control signals being transmitted between the first operating unit and the control system. Control signals could then be transmitted one after the other via the interface. This could be an Ethernet interface, a USB interface, a CAN bus, a LIN bus or another interface used in computers, or an interface used in automation technology, in particular building automation technology.

The control system of a bed according to the invention may comprise a second interface for a wireless reception of the communication signals. The second interface can be an EnOcean, Bluetooth, WiFi or some other wireless interface used in automation technology, in particular in building automation technology, or in computers.

According to the invention, the first control signals can be formed in accordance with a first specification. A control system of a bed according to the invention may comprise a communication circuit, which converts the communication signals generated by the second operating unit and received by the communication circuit into second control signals in accordance with the first specification. EnOcean signals, for example, could thus be converted into control signals in accordance with the first specification. The motor or motors or one or more other components of the bed can then be controlled by the second control signals in the same way as by the first control signals, without special adaptation of the motor or of motors or component or components to the second control signals. The first specification can, for example, involve an Ethernet specification, a USB specification or another specification used in computer hardware that describes the transmission of TCP/IP signals or other signals. The first specification can also be a specification known from the automation technology field, in particular building automation technology. The communication circuit could be a router.

The communication circuit of a control system of a bed according to the invention can comprise at least one second connection for each of the second control signals.

The control system of a bed according to the invention may comprise a logic circuit for linking the first connections and the second connections. The control signals can be brought together with the logic circuit, so that they can be transmitted to the component or components, for example the motors, via a third interface.

Another controller for the bed can be connected to the third interface, which is connected to the components of the bed and/or the external components via wired lines or wirelessly.

The linking can be achieved in a variety of ways. It is possible that, for each first control signal, the logic circuit comprises a signal line from the first connection of the first interface assigned to the first control signal to one respective interconnection node and, for each second control signal, a signal line from the second connection of the communication circuit assigned to the second control signal to one respective interconnection node, wherein the first control signal and the second control signal, with which an identical function of a component of the bed or an external component can be controlled, can be linked at each of the interconnection nodes. Each of the interconnection nodes can then be connected to one respective connection of the third interface of the control system, via which one motor or a plurality of motors are connected to the control system.

The logic circuit could also be a switch or a USB hub.

The control system of a bed according to the invention may comprise a priority circuit, which generates a priority signal as soon as a first control signal is present at one of the first connections of the first interface. The priority circuit may comprise a connection for the priority signal. The priority signal can be tapped at this connection. It indicates that a first control signal is being generated by the first operating unit. If the priority signal is being generated or the priority signal is present at the connection provided for this purpose, it can be used to prevent the generation and/or forwarding of second control signals to a component of the bed, or an external component, for example the motor or the motors of the bed.

The communication circuit of a bed according to the invention may comprise an input for the priority signal, for example a reset input, via which the connections for the second control signals can be converted into a state in which no second control signals are present at the second connections of the communication circuit, irrespective of the communication signals present at the second interface.

In a control system of a bed according to the invention, the connection of the priority circuit for the priority signal can be connected to the input for the priority signal of the communication circuit. As soon as a first control signal is generated by the first operating unit, the priority signal is switched to the input for the priority signal, thereby preventing second control signals from being generated by the communication circuit.

It is furthermore possible for the priority signal to interrupt a power supply to the communication circuit. For this purpose, a relay or a controllable switch, for example, can be inserted in a power supply circuit for the communication circuit. A control input for the relay or the switch can then be connected to the connection of the priority circuit for the priority signal. The presence of a priority signal at the connection of the priority circuit for the priority signal and at the control input can then lead to an actuation of the relay, which interrupts the electric circuit supplying the communication circuit.

It is furthermore possible to provide an emergency stop switch as the first operating unit, which is provided solely to prevent an actuation of one, several or all of the components of the bed and/or external components controlled by the second operating unit, for example, in the event of imminent danger. This first operating unit, in particular, can be designed such that it interrupts the power supply of the communication circuit.

It is possible for the bed to comprise no other first operating unit aside from an emergency stop switch as the first operating unit, but to rather have one or more second operating units.

In a bed according to the invention in another design, in which the first operating unit is connected to a switch via an Ethernet connection and the second operating unit is connected to the same switch via a router or a Bluetooth interface, and the switch is also connected to the motor or the motors, controllers or driver circuits of the motors can be programmed such that first control signals are processed with a higher priority and any simultaneously present second control signals are ignored.

BRIEF DESCRIPTION OF THE DRAWINGS

Further features and advantages of the present invention are described with reference to the accompanying drawings.

DETAILED DESCRIPTION

Figure 1:
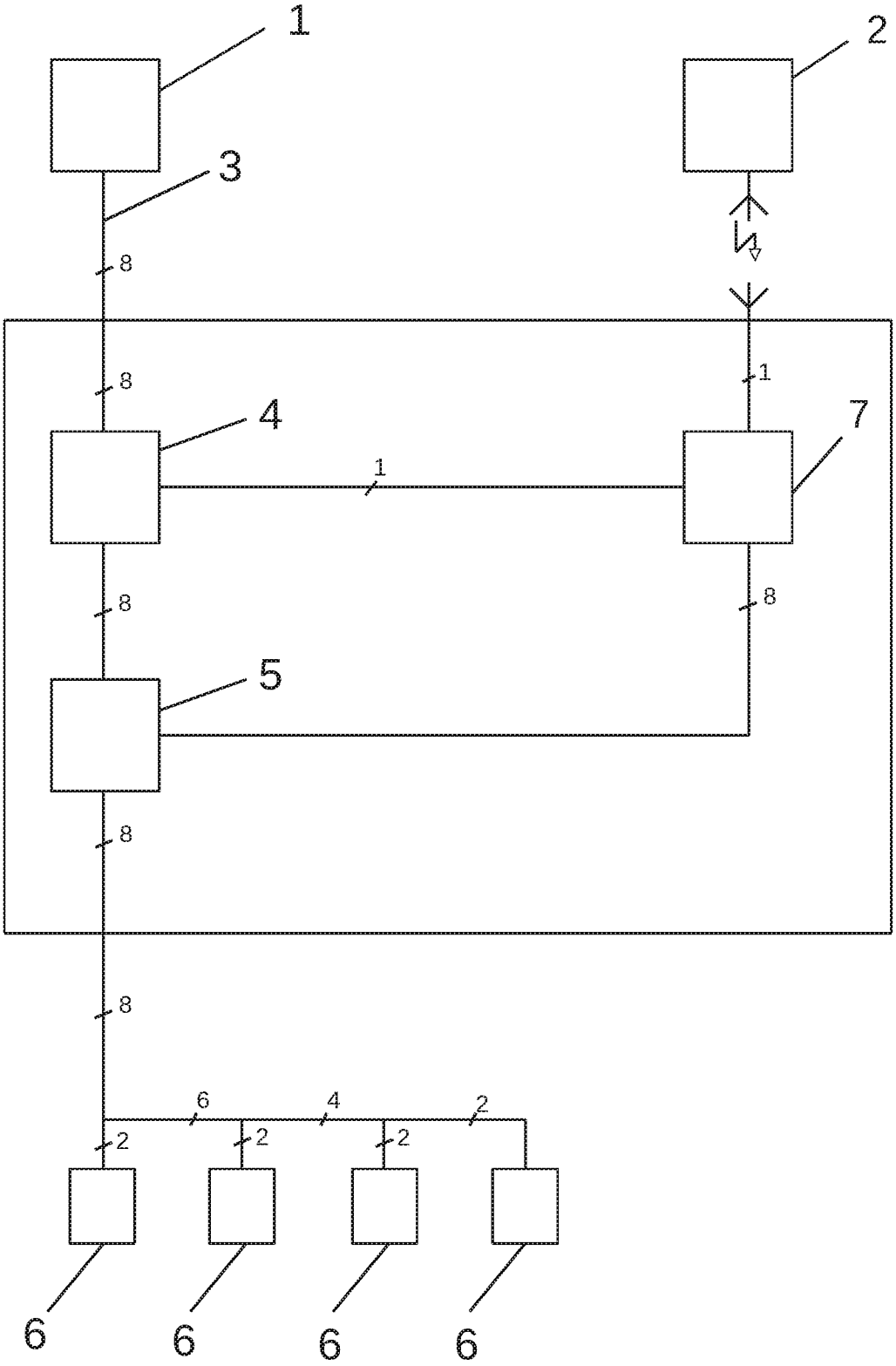
FIG. 1 is a block diagram of an arrangement comprising a first operating unit, a second operating unit, a control system and motors of a bed according to the invention.

A bed according to the invention comprises a first operating unit 1 and a second operating unit 2. The first operating unit 1 has an interface and the interface is connected via a wire 3, which in the example is at least an eight-pole wire, to a first (eight-pole) interface S1 of a control system 4, 5, 7 of the bed. Within the control system, the interface S1 is connected to a priority circuit 4 via (eight) lines. The priority circuit 4 is connected to a logic circuit 5 via (eight) lines. The logic circuit 5 is connected to a third (eight-pole) interface S3 of the control system 4, 5, 7, in the example with four motors 6, via (eight) lines.

The second operating unit 2 is connected with a second interface S2 of the control system 4, 5, 7 via a wireless interface. Within the control system (4, 5, 7), the second interface S2 is connected with a communication circuit 7. The communication circuit 7 is connected, on one hand, to the priority circuit 4 via one line and, on the other hand, to the logic circuit 5 via (eight) lines.

The first operating unit 1 comprises further operating elements (not depicted), which are connected to likewise electric switches or pushbuttons (not depicted). Electric circuits can be opened or closed by actuating the operating elements.

In a conventional bed, these electric circuits lead to one of the motors via a line and back to the first operating unit via a ground line. In a conventional bed, voltages are applied to the inputs of the motors 6 or the driver circuits of the motors 6 by opening and closing the electric circuits. The driver circuits then switch the motor 6 on or off in one or the other direction of rotation in accordance with the voltages.

Furthermore, in a bed according to the invention, the switches or pushbuttons in the first operating unit are connected with the inputs of the driver circuits of the motors 6 via lines. The priority circuit 4 and the logic circuit 5 are provided in the line path between the first operating unit 1 and the driver circuits of the motors. In a bed according to the invention, the first control signals generated by the first operating unit 1 are not changed by the priority circuit 4 and the logic circuit 5. The first control signals conform to the same specification as in a conventional bed, in which the first operating unit 1 is directly connected to the driver circuits of the motors 6.

The second operating unit 2 also comprises operating elements. These operating elements actuate an EnOcean sensor. As a result of an operation, this sensor generates both electrical energy and communication signals that are transmitted wirelessly to the communication circuit 7.

Figure 2:
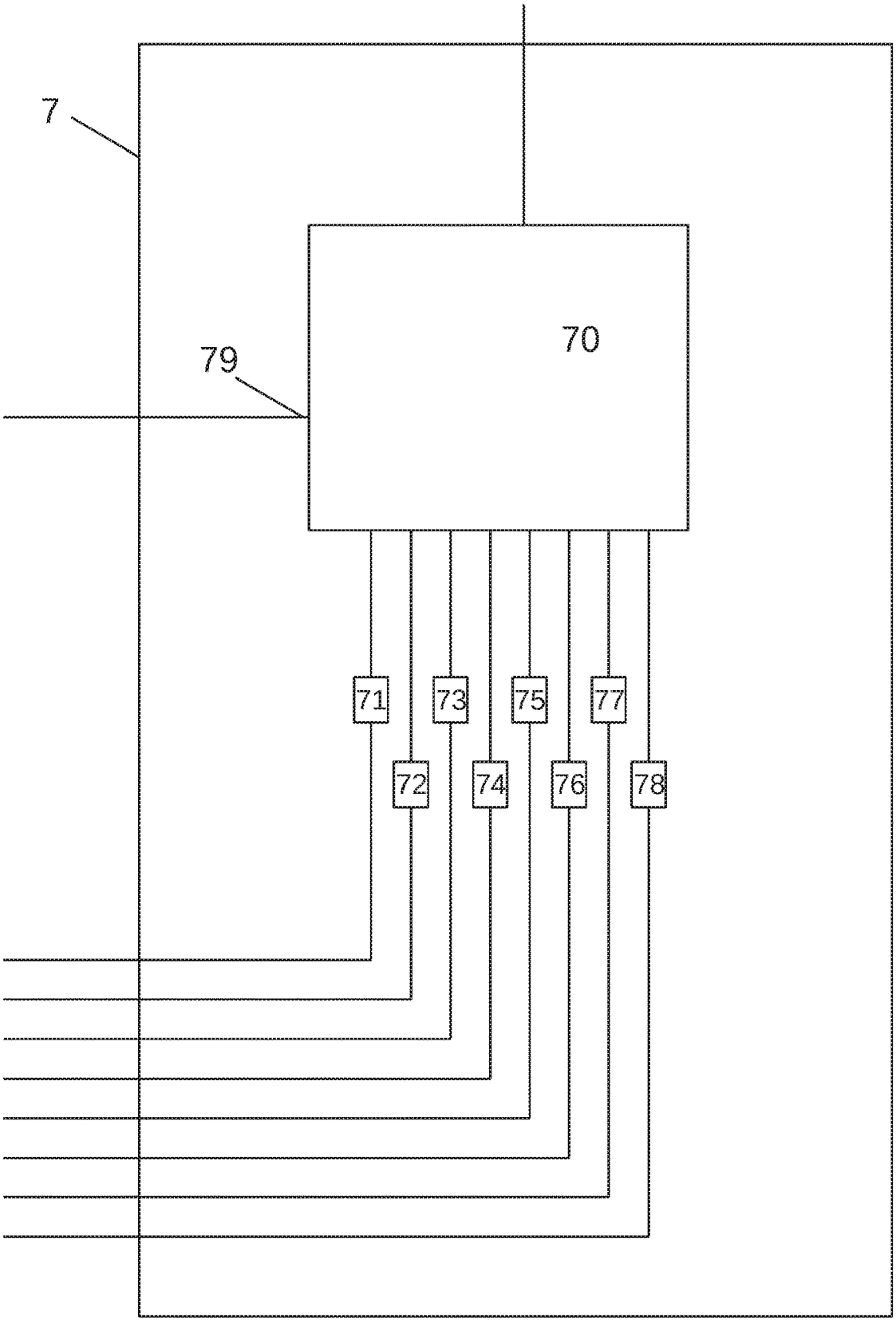
FIG. 2 is a simplified circuit diagram of the communication circuit.

The communication signals are received by the communication circuit 7. For this purpose, the communication circuit 7 comprises an EnOcean actuator 70, which controls the signal generators 71 to 78, which generate second control signals that conform to the specification of the first control signals, as shown in FIG. 2. These second control signals are transmitted to the logic circuit 5. A line is provided for each second control signal.

Figure 3:
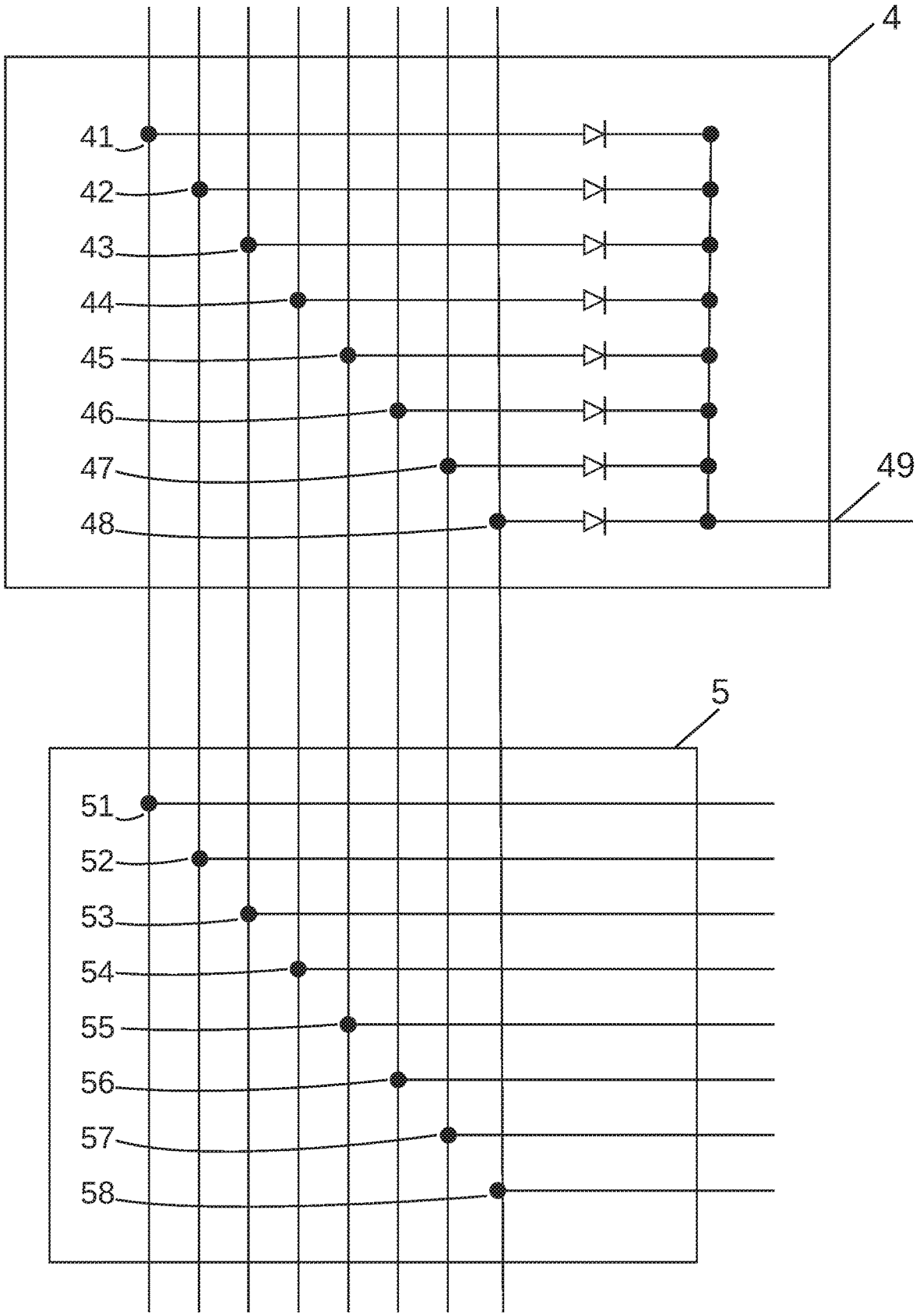
FIG. 3 is a simplified circuit diagram of the logic circuit and the priority circuit.

The logic circuit 5 comprises interconnection nodes 51 to 58, as shown in FIG. 3. In these interconnection nodes, the lines from the first operating unit 1 to the motors 6 are connected to the lines from the communication circuit 7 to the logic unit. As a result of this linking, the second control signals can also be transmitted to the driver circuits of the motors 6, which then set the motors 6 in operation, if need be in the desired direction.

The priority circuit 4, which ensures that the first control signals, i.e., the control signals from the first operating unit 1 connected via the wire 3, have priority over the second control signals, which are generated by the second, wirelessly connected operating unit, is provided to prevent potentially also contradicting, simultaneous control signals to be transmitted from the first operating unit or from the second operating unit to the motors 6.

The priority circuit 4 comprises eight input lines. One each of these lines is connected to the lines between the interconnection nodes 51 to 58 and the connections of the first interface S1 of the control system via a connection node 41 to 48. The input lines are brought together in a node 49. A diode is connected between the connection nodes 41 to 48 and the node 49 in each of the input lines, so that a current can flow from the connection nodes 41 to 48 to the node 49 but not in the other direction. As a result of this circuitry, it is possible to make the determination at the node 49 that one of the first control signals is controlling one of the motors 6. According to the invention, if one of the first control signals is controlling one of the motors 6, no second control signal can control any of the motors 6. The signal present at the node 49 thus indicates that the first operating unit 1 has to be granted priority and is therefore referred to as the priority signal.

This priority signal is sent to the communication circuit 7. The communication circuit 7 has a reset input 79 that is connected to the node 49. As a result of the presence of the priority signal at the reset input 79, the communication circuit 7 does not generate any second control signals. Consequently, only the first control signals are present at the interconnection nodes 51 to 58.

If no first control signal is generated by the first operating unit 1, however, there is no priority signal at the reset input 79 of the communication circuit 7. The communication circuit 7 is then able to generate second control signals, which are sent to the interconnection nodes 51 to 58 and then ultimately to the driver circuits of the motors 6.

What is claimed is:

1. A bed with controllable components including switches or motors of a motor-adjustable lying surface of the bed or an external interface for controlling components outside the bed via control signals, comprising:

a first operating unit to operate at least one of the components, wherein the first operating unit comprises a first interface to transmit first control signals via a wire;

a second operating unit to operate at least one of the components, wherein the second operating unit comprises a second interface for the wireless transmission of communication signals; and a control system to receive the first control signals from the first operating unit and to receive the communication signals from the second operating unit, wherein the control system is configured to prioritize operation of a component within or outside the bed with the first operating unit over operation of the component with the second operating unit.

2. The bed of claim 1, wherein each of the first control signals leads to a rejection of one of the communication signals by the control system.

3. The bed of claim 1, wherein the control system comprises a first interface to receive the first control signals.

4. The bed of claim 3, wherein the wire between the first operating unit and the first interface is an Ethernet bus line, and the third interface is an Ethernet interface.

5. The bed of claim 3, wherein the first interface comprises at least one first connection for each of the first control signals.

6. The bed of claim 3, wherein the control system comprises a second interface to wirelessly receive the communication signals.

7. The bed of claim 6, wherein the connection between the second operating unit and the second interface is a Bluetooth interface or a WiFi interface.

8. The bed of claim 6, wherein:

the first control signals are generated according to a first specification; and the control system further comprises a communication circuit to convert the communication signals received by the control system via the second interface into second control signals according to the first specification.

9. The bed of claim 8, wherein the communication circuit is a router and the logic circuit is a switch.

10. The bed of claim 8, wherein the communication circuit comprises at least one second connection for each of the second control signals.

11. The bed of claim 10, wherein the control system further comprises a logic circuit to respectively link the at least one first connection and the at least one second connection, such that first and second control signals that control a same function are linked by the logic circuit to a same one of the components.

12. The bed of claim 11, wherein, for each first control signal the logic circuit comprises a signal line from the first connection of the first interface assigned to the first control signal to one respective interconnection node and for each second control signal a signal line from the second connection of the communication circuit assigned to the second control signal to one respective interconnection node, wherein, at each of the interconnection nodes, the lines for the first control signal and the second control signal, with which an identical function can be controlled, are linked.

13. The bed of claim 12, wherein each of the interconnection nodes is connected to one respective third connection of a third interface of the control system, via which the components are connected to the control system.

14. The bed of claim 12, wherein the control system further comprises a priority circuit to generate a priority signal in response to a first signal being present at one of the first connections of the first interface.

15. The bed of claim 14, wherein the priority circuit comprises a connection for the priority signal.

16. The bed of claim 15, wherein the communication circuit comprises a reset input via which second control signals present at connections of the communication circuit for the second control signals can be disabled irrespective of the communication signals present at the second interface.

17. The bed of claim 16, wherein the connection of the priority circuit for the priority signal is connected to the reset input of the communication circuit.

* * * * *